United States Patent [19]

Bommer

[11] Patent Number: 4,796,569

[45] Date of Patent: Jan. 10, 1989

[54] FURNACE BOILER AND PROCESS FOR THE OPERATION OF THE BOILER

[76] Inventor: Rolf Bommer, Hochbildstrasse 21, 7770 Ueberlingen, Fed. Rep. of Germany

[21] Appl. No.: 144,540

[22] Filed: Jan. 15, 1988

[30] Foreign Application Priority Data

Jan. 20, 1987 [DE] Fed. Rep. of Germany ..... 3701439

[51] Int. Cl.[4] ..... F22B 37/00

[52] U.S. Cl. ..... 122/6 A

[58] Field of Search ..... 122/6 A; 165/95, 101

[56] References Cited

U.S. PATENT DOCUMENTS 3,120,869 2/1964 Carpenter ..... 122/6 A X
3,704,747 12/1972 Andoniev et al. ..... 165/101
4,026,352 5/1977 Andoniev et al. ..... 165/95
4,250,840 2/1981 Kudinov et al. ..... 122/6 A
4,655,793 4/1987 Pohl ..... 122/6 A X

*Primary Examiner*—Edward G. Favors
*Attorney, Agent, or Firm*—Eugene E. Renz, Jr.

[57] ABSTRACT

A process for operating a furnace boiler with a firebox having a cooled wall and at least one blowpipe to direct flame into the firebox, and heat exchangers connected to the firebox through which the flue gases flow, consisting of the steps of extracting heat from the flue gases essentially only by the heat exchangers and cooling the wall of the firebox only to the extent that, at maximum burner output, the temperature on the inner side of the wall does not exceed approximately 600° C. and, when the burner output is reduced to about 1/10 of maximum output, the temperature does not fall below approximately 180° C.

25 Claims, 4 Drawing Sheets

FIG. 9
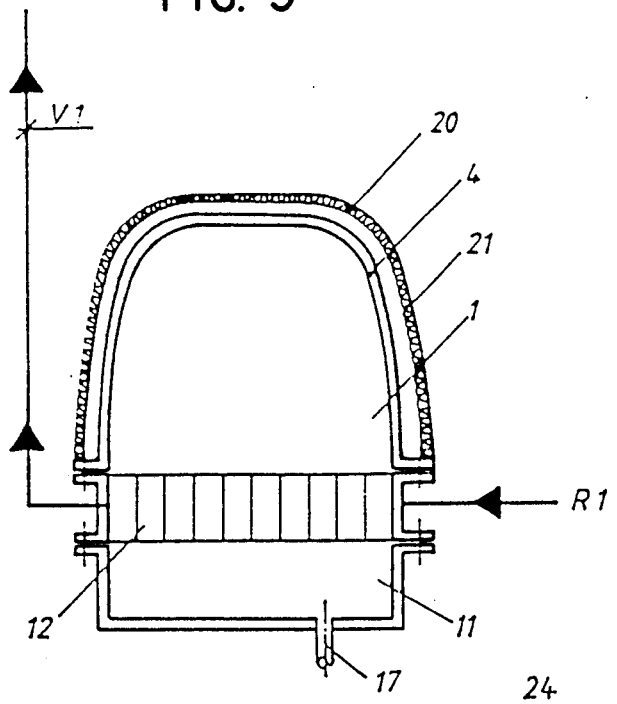
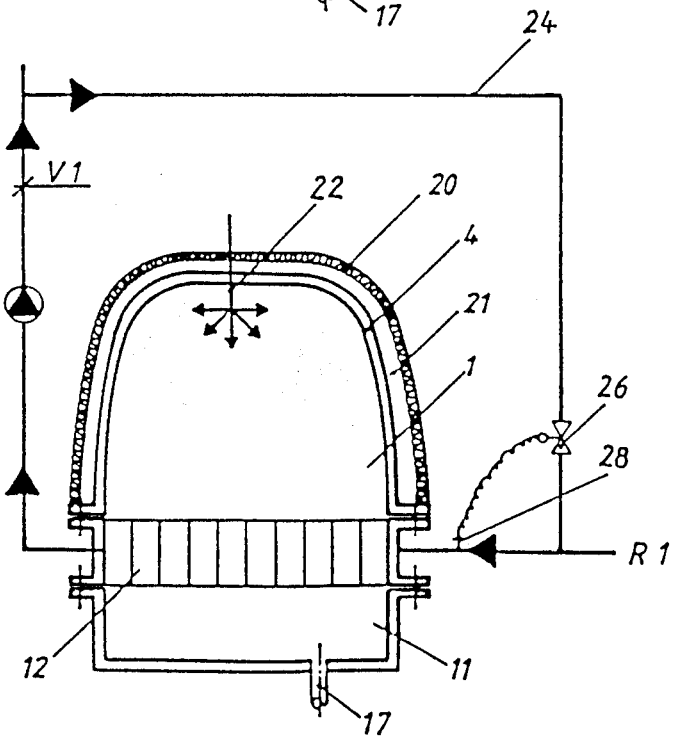
FIG. 10

FURNACE BOILER AND PROCESS FOR THE OPERATION OF THE BOILER

FIELD OF THE INVENTION

The invention pertains to a new and useful process for the operation of a furnace boiler and to improvements in a furnace boiler.

BACKGROUND OF THE INVENTION

West German Offenlegungsschrift No. 3,537,704 discloses a furnace boiler, in which a blowpipe with a horizontally directed flame burns in a firebox, which is oriented horizontally and which is open over its entire length and width along its lower side, which is essentially parallel to the axis of the flame of the blowpipe, toward a flue gas collection space containing heat exchangers. The walls of the firebox are cooled by a water jacket, through which the utility water to be heated and the water of the heating system flow. The water jacket which cools the walls of the firebox takes up most of the heat generated by the burner, whereas the heat exchangers installed in the adjoining flue gas collection space act only as a secondary heating surface, which cool the flue gases down to a temperature of about 160°–180° C., at which temperature the flue gases enter the chimney.

The large volume of the water jacket surrounding the walls of the firebox cools these walls intensively. The blowpipe must, therefore, be operated at a constant burner output, which is coordinated with the cooling of the firebox wall. Reducing the burner output, e.g., to adapt to a lower heating need between seasons, would lead to the overcooling of the flame, which results in a high pollutant level in the flue gases and even to condensation on the firebox wall. The output of the blowpipe can, therefore, not be reduced to adjust to reduced heating needs. The burner is instead operated intermittently at maximum output. This intermittent operation means in turn that the burner has to be started up frequently, and each time this happens the entire volume of the water jacket cooling the firebox wall must be heated up again. In this heat-up phase, the burner flame is always overcooled, with the result that the pollutant level increases and efficiency declines.

To prevent the disadvantages of the overcooling of the flame, preferably so-called combustion aids are installed in small furnace boilers of low output up to about 40 kW. The firebox wall enclosed and cooled by the water jacket consists of a cylindrical casting, in which a high-grade steel pipe is inserted coaxially. The burner flame burns inside this pipe. The high-grade steel pipe is held in place a certain distance away from the walls of the casting by inward-facing ribs on the walls. The hot combustion chamber formed by the high-grade steel pipe is, therefore, in practice not cooled. Because of the low heat capacity and the absence of cooling, this combustion chamber reaches a high temperature very quickly when the burner is started, which means that the fuel is burned without residue not only during continuous operation but also very soon after the burner has been started. Only while the combustion gases are flowing between the combustion chamber and the cast wall of the firebox is any heat extracted from them.

In this furnace boiler, the high temperature in the hot combustion chamber and the long residence time of the combustion gases in the hot combustion chamber convert a large amount of the nitrogen from the atmosphere into $NO_x$, which means that the waste gases contain a large percentage of harmful nitrogen oxides. In spite of its ribs, the firebox wall surrounding the combustion chamber coaxially cannot extract enough heat from the hot flue gases. For this reason, it is usually necessary to provide secondary heating surfaces to achieve a satisfactory degree of efficiency. These make the design of the furnace boiler more complicated. The firebox wall, which usually consists of cast iron, and the surrounding water jacket have a high heat capacity, which means that the furnace boiler has a large amount of inertia. The heat capacity is influenced in particular by the fact that the firebox must have a large volume so that it can hold the hot combustion chamber used and provide a sufficiently large heat exchange surface.

From West German Pat. No. 3,205,121, finally, it is known that the wall of the firebox of a furnace boiler can be made of a double layer of sheet metal, the inner and the outer walls touching each other only at certain points to thereby reduce the heat transfer from the inner to the outer walls. The inner wall thus reaches a relatively high temperature, whereas the outer wall is cooled by the water jacket of the furnace boiler surrounding the wall coaxially.

The reduction of the heat transfer from the inner wall to the outer wall is problematic in this furnace boiler, because it is impossible to heat the water jacket cooling the outer wall economically when the heat transfer is too low; whereas, when the heat transfer is too high, the inner wall and thus the flame, become overcooled, with all the attendant disadvantages described above. Because the firebox walls serve to transfer heat to the heating water, this furnace boiler can also be operated only at an essentially constant burner output. Reducing the burner output to adjust to a lower heat requirement is impossible especially during continuous operation, because the flame becomes overcooled at the cooled firebox wall.

SUMMARY OF THE INVENTION

With the foregoing in mind, an object of the present invention is to provide an improved furnace boiler which, while ensuring the combustion of the fossil fuel with the least possible amount of residue, produces the least possible amount of $NO_x$, preferably even when burner output is adjusted to changing heating requirements.

The essential idea of the invention consists in extracting the heat from the combustion gases not at the firebox wall but almost exclusively at the heat exchangers in the flue gas collection space. The wall of the firebox is cooled only slightly. The degree of cooling is calculated in such a way that the temperature on the inside wall of the firebox does not exceed approximately 600° C. even during continuous operation at full burner output. This gentle cooling of the firebox walls causes the combustion gases at the edge of the burner flame to cool down very quickly to a temperature at which virtually negligible $NO_x$ formation occurs. Because the cooling of the firebox walls does not serve the purpose of heating the heating or utility water, the degree of cooling is kept so low that even when the burner output drops, the combustion gases at the firebox walls do not become overcooled. The burner output can, therefore, be reduced to about 1/10 of maximum output without cooling the walls of the firebox leading to a cooling of the combustion gases below a temperature of about 180° C., at which the combustion of the fuel no longer occurs completely. In the furnace boiler according to the invention, therefore, the burner output can be varied over a very wide range from preferably 1 to 10 without the occurrence of incomplete combustion and condensation on the walls of the firebox at low burner outputs and without an increase in the $NO_x$ levels of the waste gases at high burner outputs. The hot combustion gases do not come into contact with the heat exchangers, through which the combustion gases are conducted, until they have already left the combustion space and have entered the flue gas collection space. The cooling of the combustion gases on the heat exchangers can, therefore, not cause the flame to cool.

Because the firebox does not serve to extract a large amount of heat from the combusion gases to heat the water, the firebox can have a very small volume. It must only be large enough essentially just to surround the flame of the burner. The small volume of the firebox also means that the residence time of the combustion gases near the flame is reduced, and this brings about a further reduction in the amount of $NO_x$ produced. The firebox surrounds the flame of the burner on three longitudinal sides and on the end opposite the burner, whereas it is open on the fourth longitudinal side to the flue gas collection space. This enclosure of the flame by the firebox brings about a recirculation of the hot combusion gases against the direction of the flame in the manner of the reverse flame in furnace boilers with a hot combustion chamber. The side opening of the firebox toward the flue gas collection space, however, brings about an additional circulation of the combustion gases around an axis parallel to the flame, so that two spiral circulating flows of combustion gases form in the firebox on both sides of the flame. By means of this circulation, the combustion gases are conducted along the preferably barrel-vaulted longitudinal wall of the firebox and thus gently cooled, so that their temperature does not exceed the temperature at which $NO_x$ formation starts to accelerate. Because of the rotating type of circulation, some of the gases cooled at the firebox wall are returned to the core of the flame, so that complete and residue-less combustion of the fossil fuel is guaranteed. Some of the circulating gases flow continuously to the heat exchangers in the flue gas collection space.

The flue gas collection space is located preferably underneath the firebox. In this way, the flow of flue gases, the temperature of which is decreasing continuously as a result of contact with the heat exchangers, is promoted. It is a particular advantage, when the furnace boiler is designed as a so-called calorific value boiler, in which the waste gases are cooled on the outlet side of the heat exchanger to below the dew point, so that the water vapor present in the waste gases condenses and separates out together with the residual pollutants, especially sulfur oxides, ash, heating oil residues, that the condensate at the bottom of the flue gas collection space can be discharged at the bottom of the flue gas collection space. The heat exchangers, which preferably extend through the flue gas collection space as a register of pipes, can be designed to have a relatively low heat capacity, so that the furnace boiler reacts with low inertia and low energy losses.

The walls of the firebox are thin, have a low heat capacity, and are corrosion-resistant at least on the inner side. The low heat capacity results in minimum inertia of the firebox wall, so that it arrives at the desired optimum temperature of about 300°-500° C. within seconds after the burner has been ignited. Even when the burner is started up, therefore, the overcooling of the flame and the associated emissions of pollutants are minimal. Because, according to the invention, it is also possible in particular to vary the burner output without any disadvantageous effects on efficiency or on the pollutant level of the waste gases, the burner output can be reduced when the heating requirement is low, which means that the number of times the burner has to be started can be considerably reduced.

The corrosion-resistant, gently cooled firebox wall with low heat capacity required according to the invention can be realized in various ways.

The walls of the firebox can consist of two layers. The inner wall is thin and consists of a corrosion-proof material, preferably sheet steel with a thickness of about 0.5-2.5 mm or a thin-walled ceramic material. The outer wall is preferably attached loosely to the inner wall and held in place against the inner wall under a uniformly applied pretension. The outer wall consists preferably of sheet copper or aluminum with a thickness of about 0.5-1.5 mm, on which watercarrying coils of tubing are soldered or welded for cooling. It is also possible to stamp water channels into the sheet. That the outer wall is installed under tension around the inner wall in a removable manner offers the advantage that the outer wall can be replaced to adjust its cooling output to the burner. In addition, the cooling output can be controlled by varying the pressure with which the outer wall is pressed against the inner wall, e.g., by means of the hydraulic control of the pretension. The contact surface between the inner and out walls increases with the pressure, and thus the heat transfer for cooling increases. The material of the outer wall, which has good thermal conductivity, effects the uniform cooling of the entire wall of the firebox in spite of the small number of coils provided at certain distances from each other.

In another embodiment, the wall of the firebox can also consist of a casting, such as cast iron. The water channels carrying the cooling water are cast in place. A limited number of them are provided a certain distance apart from each other.

If the burner output during operation is varied over a wide range to adjust to changes in heating requirements, it is advantageous to adjust the cooling of the firebox wall as well in order to keep its temperature as close as possible to the optimum value of about 400°-500° C. For this purpose, the liquid throughput through the water channels carrying the cooling water can be controlled.

Preferably water which has already been preheated in the heat exchangers, preferably in the heat exchanger the farthest away from the burner, is used to cool the firebox walls. This is because the firebox walls are not intended to heat water but rather only to provide gentle cooling so that the wall temperature does not increase excessively.

Because only the gentle cooling of the firebox wall is both required and desirable, the firebox wall can also be cooled with air. The air which is heated during the cooling of the firebox wall can be used advantageously as combustion air for the blowpipe.

The heat exchangers located underneath the firebox are preferably designed so that they conduct the combusion gases only from the top toward the bottom and have no horizontal drafts for the combustion gases. In addition to the favorable flow conditions for the combustion gases, this also offers the advantage that any combustion residues which may be present such as soot and the like cannot settle on the heat exchangers. Instead, they are collected together with the condensate and removed. The effectiveness of the heat exchangers is, therefore, not impaired by deposits.

The firebox open along its bottom and the vertical guidance of the combustion gases through the heat exchangers make it particularly easy to clean the furnace boiler. A spray device for a cleaning liquid, preferably water, can be provided at the top of the firebox, and the cleaning liquid can be sprayed through it into the firebox. The cleaning liquid rinses off both the wall of the firebox and the heat exchangers and flows downward through the heat exchangers, at the bottom of which it si collected and removed. The entire furnace boiler can be very easily cleaned in this way either as needed or automatically at predetermined intervals without the need for manual cleaning work or even partial disassembly of the boiler.

The walls of the flue gas collection space can be produced as a single unit together with the inner wall of the firebox when the firebox is made with two layers. Because the firebox is completely separate functionally from the heat exchanger and the flue gas collection space, it is also possible to design the heat exchanger and the flue gas collection space as independent components, which are connected removably to the firebox in a gas-tight and water-tight manner. In this way, it is especially easy to use a heat exchanger which is adapted to the specific conditions at hand in conjunction with a firebox which can be produced uniformly on a mass basis for a wide spectrum of applications. It is also possible to replace the firebox without the need to make any changes in the furnace boiler when such replacement becomes advisable in order to adapt the system to future improvements in burner design. Finally, this has the advantage that the firebox can also be used in conjunction with heat exchangers and flue gas collection spaces of different manufacturers.

At furnace outputs of up to about 40 kW, the firebox can have a volume of preferably about 6–12 $dm^3$. The length-to-width ratio is preferably in the range of 1.5–1.0, whereas the length-to-height ratio of the firebox is preferably in the range of 2.0–1.0. At these dimensions, an especially favorable pattern of circulating combustion gas flows and a favorable ratio of combustion gases recirculating in spirals back to the flame to the combustion gases escaping to the flue gas collection space are achieved.

BRIEF DESCRIPTION OF THE DRAWINGS

These and other objects of the present invention and the various features and details of the operation and construction thereof are hereinafter more fully set forth with reference to the accompanying drawings, wherein:

FIG. 9 shows a cross section of a fifth embodiment; and

FIG. 10 shows a cross section of a sixth embodiment.

BRIEF DESCRIPTION OF THE PREFERRED EMBODIMENTS

Figure 1:
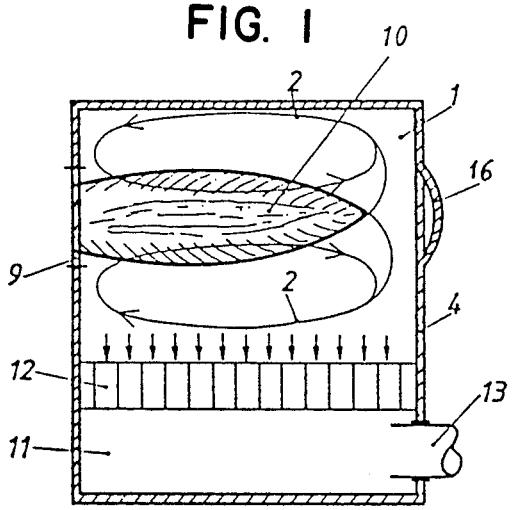
FIG. 1 is a schematic diagram of a longitudinal section of the furnace boiler showing the circulating flows of combustion gases.
Figure 2:
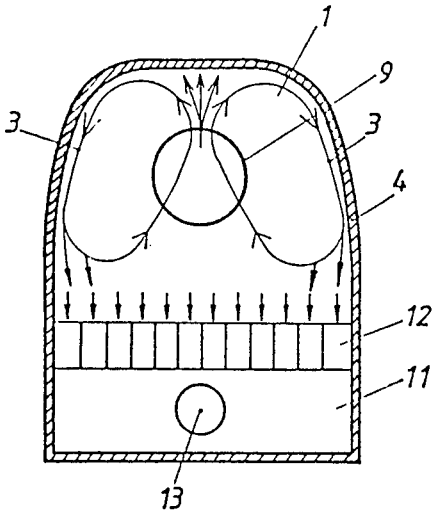
FIG. 2 is a schematic diagram of a cross section of the furnace boiler showing the circulating flows of combustion gases.

As shown in FIGS. 1 and 2, the furnace boiler consists of a barrel-vaulted firebox 1, which is closed at its two axial ends. In the center of one end wall is an opening 9, in which a compressed air-oil or gas blowpipe burner, according to DIN 4,788 Parts b 2–5, can be installed. Flame 10 of the burner burns horizontally in the axial direction into firebox 1.

At the bottom, firebox 1 is open over its entire axial length and continues as a flue gas collection space 11, which has the same length and width as firebox 1. The open boundary surface between firebox 1 and flue gas collection space 11 is about $\frac{1}{3}$–$\theta$ of the entire peripheral lateral surface of firebox 1. Flue gas collection space 11 is occupied by a heat exchanger 12 oriented horizontally, which has the form of a pipe register. Underneath heat exchanger 12 is an outlet 13, by means of which flue gas collection space 11 can be connected to a chimney.

Firebox 1 is about 1.5–1.0 times as long as it is wide and about 2.0–1.0 times as long as it is high. The overall volume of firebox 1 is about 6–12 $dm^3$.

Figure 3:
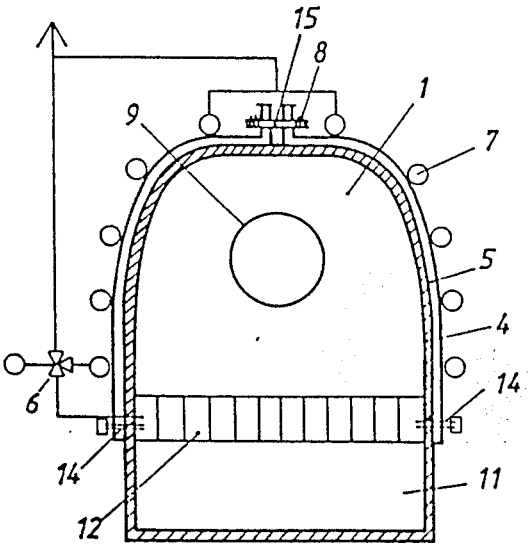
FIG. 3 is a schematic diagram of a cross section of the furnace boiler with an outer wall.

In the exemplary embodiment of FIGS. 1–3, firebox 1 and flue gas collection space 11 are surrounded in a gas-tight manner by a common wall 4, which consists of sheet steel 0.5–2.5 mm thick. In the area of firebox 1, an outer wall 5 is provided around the outside of wall 4. This outer wall rests loosely against the ends and peripheral lateral surfaces of wall 4. Outer wall 5 is attached to wall 4 by means of screws or pins 14 in the area of the lower edge of firebox 1. Outer wall 5 consists of sheet copper or aluminum with a thickness of 0.5–1.5 mm. It extends, starting from the points at which it is attached by screws or pins 14, in two sections upward over firebox 1 and is held, for example, at the top on the crest of firebox 1 by bolts 15. Springs 8 seated on bolts 15 tension outer wall 5 over wall 4 and cause outer wall 5 to press against wall 4, which produces limited areas of thermally conducting contact between wall 4 and outer wall 5. Increasing the pressure of springs 8 increases the area of contact and thus improves the heat transfer between wall 4 and outer wall 5, whereas a weaker pressure of springs 8 leads to less contact and less effective heat transfer. It is preferable to use hydraulically controlled tensioning devices instead of springs 8. These devices tension outer wall 5 with an adjustable pressure, and thus the heat transfer via wall 4 can also be adjusted.

Figure 4:
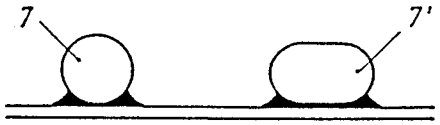
FIGS. 4 and 5 show different designs of the coils of tubing on the outer wall shell.
Figure 5:
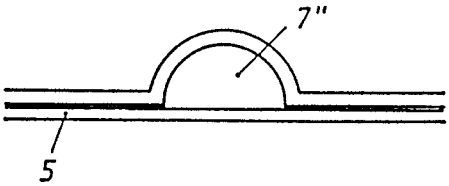

Meander-shaped coils 7 of tubing are located on the outer wall. These coils are uniformly distributed a certain distance apart from each other over the end and lateral surfaces of outer wall 5. The distance between the individual turns of coils 7 is determined by the degree of cooling required. Tubing coils 7 can be soldered or welded onto outer wall 5, as shown in FIG. 4, and they can be round or oval in cross section, as shown in FIG. 4 by the cross sections 7, 7'. The outer wall can also be a double shell of sheet metal with stamped-in channels to provide coils 7", as shown in FIG. 5.

A coolant is conducted through coils 7, for which purpose preferably a fraction of the water preheated in heat exchangers 12 is used, which is branched off by way of a control valve 6 at a controlled rate.

As can be seen from FIGS. 1 and 2, the hot combustion gases of flame 10 flow in an axial recirculating flow back against the direction of flame 10. This recirculation can be promoted by an outward curvature 16, indicated in FIG. 1, in the end wall of firebox 1 opposite the burner. Because of the asymmetric opening of firebox 1 toward flue gas collection space 11, the axial return flow of combustion gases acquires an additional component of motion in the radial direction, which carries primarily the combustion gases flowing upward from flame 10 downward along cooled firebox wall 4. Some of the combustion gases conducted downward in this way along with radial circulating flow 3 flows through heat exchanger 12 into flue gas collection space 11, while the rest is returned by the rotational circulating flow 3 back into flame 10.

As a result of the axial recirculation with its swirling flows on both sides of flame 10 along cooled wall 4, a sufficient amount of combustion gas is returned to flame 10 to guarantee complete combustion. At the same time, the combustion gases returned to the flame are cooled to certain extent, which prevents an excessive flame temperature and thus helps prevent the formation of $NO_x$. The continuous downward flow of hot combustion gases into the flue gas collection space in conjunction with the small volume of firebox 1 means that the residence time of the combustion gases to firebox 1 is short, which also helps to prevent the formation of $NO_x$ in the waste gases.

Figure 6:
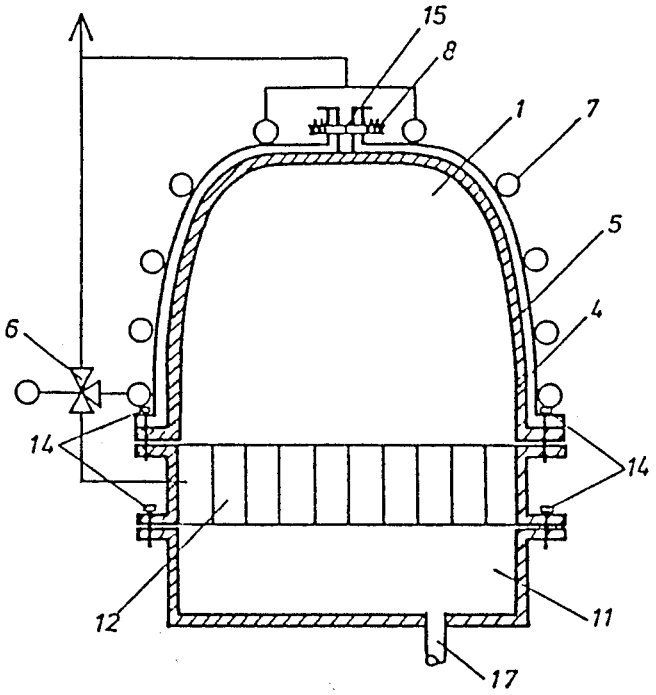
FIG. 6 shows a cross section of a second embodiment.

FIG. 6 shows a second embodiment of the furnace boiler. In this embodiment, firebox 1 with its wall 4 is a separate component, which is connected removably by means of threaded bolts 14, which also serve to attach outer wall 5 to heat exchanger 12. Heat exchanger 12 is, in turn, connected removably by means of threaded bolts 14 to adjacent flue gas collection space 11. The connection between firebox 1 and heat exchanger 12 and that between heat exchanger 12 and flue gas collection space 11 are gas-tight and liquid-tight. For use as a calorific value boiler, in which the flue gases are cooled below the dew point and condense, a condensate drain 17 is provided in the bottom of flue gas collection space 11.

Figure 7:
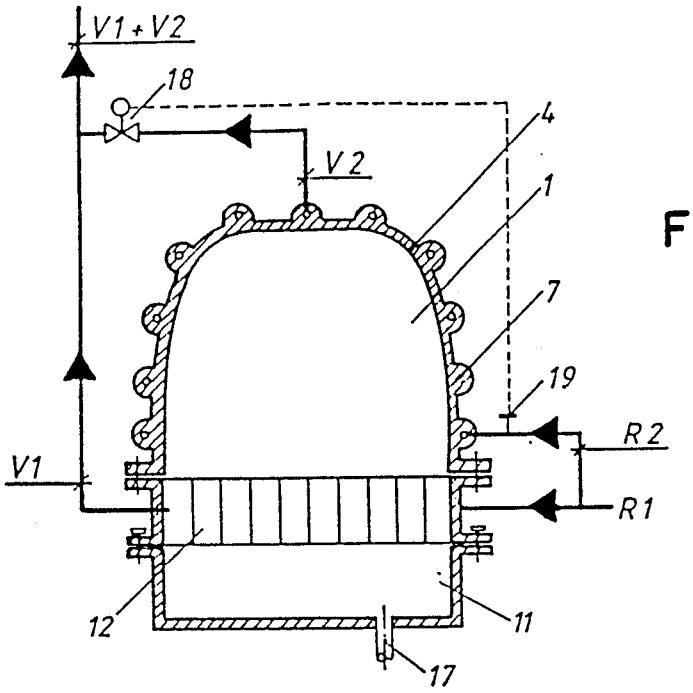
FIG. 7 shows a cross section of a third embodiment.

FIG. 7 shows a third exemplary embodiment, in which wall 4 of firebox 1 consists of a thin-walled casting, e.g., of cast metal or of ceramic material. Coils 7 are formed by channels cast onto wall 4. Heat exchanger 12, flue gas collection space 11, and the connection of firebox 1 to heat exchanger 12 and of heat exchanger 12 to flue gas collection space 11 are the same as in the exemplary embodiment of FIG. 6. The cold return water of a heating system is supplied via a return line R1 to heat exchanger 12, where it is heated. This water is then conducted through feed line V1 back to the heating system. A line R2 branches off from line R1. A small partial stream of the cold return water is introduced via this branch line R2 into coils 7 to cool firebox wall 4. A feed line V2 feeds the cooling water, after it has passed through coil 7, to feed line V1 and thus into the heating system. A control valve 18 installed in line V2 controls the flow rate of the cooling water through coils 7 in accordance with the temperature of the return water in line R2, which is determined by a sensor 19. The control of the flow rate by means of control valve 18 ensures that the temperature on the inside of wall 4 does not exceed 600° C. and that, when the output of the burner decreases, the temperature does not drop to such a point that the combustion gases in firebox 1 become overcooled.

Figure 8:
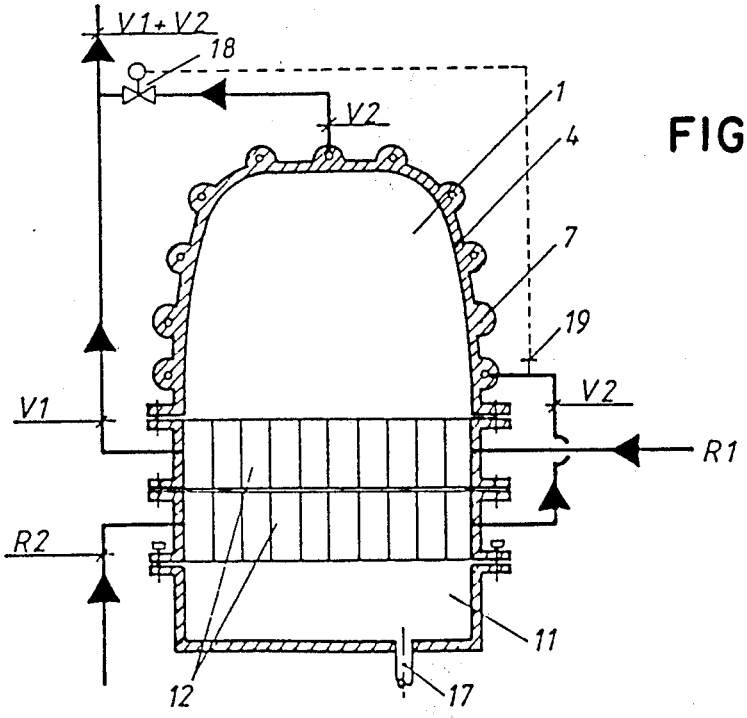
FIG. 8 shows a cross section of a fourth embodiment.

FIG. 8 shows an additional embodiment, in which wall 4 of the firebox is designed in the same way as for the exemplary embodiment of FIG. 7. In contrast to the embodiment of FIG. 7, however, two heat exchangers 12 are installed in series in the direction of flow of the flue gases. The return water from the heating system is supplied via return line R1 to the upper heat exchanger 12 closer to the burner; after it has been heated in heat exchanger 12, it is sent back via feed line V1 to the heating system. Lower heat exchanger 12 farther away from the burner serves to cool the flue gases, which have already been cooled by the upper heat exchanger, to the point of condensation, so that the furnace boiler can be operated as a calorific value boiler. To achieve the necessary cooling of the flue gases below the condensation point at lower heat exchanger 12, cold water from the lowermost, coldest layer of a stratified storage system is supplied to lower heat exchanger 12 via line R2. This water, which is preheated in lower heat exchanger 12, is then sent via line V2 to coils 7 to cool wall 4 of firebox 1. Here, too, the flow rate is adjusted by means of control valve 18 in accordance with the water temperature in pipeline V2, which is determined by sensor 19. Because there is only a small amount of heat remaining to be extracted from the flue gases for condensation by lower heat exchanger 12, only a small amount of cold water has to be supplied to lower heat exchanger 12. This low flow rate is sufficient to cool firebox wall 4, because this needs to be cooled only to the extent that the temperature on the inside of wall 4 does not exceed about 600° C.

FIG. 9 shows a fifth exemplary embodiment of the furnace boiler, in which wall 4 of firebox 1 consists, as in the exemplary embodiment of FIG. 6, of thin steel sheet. Wall 4 is enclosed by an air-tight, thermally insulating shell 20 and spaced therefrom to define an air channel 21 over the entire surface of wall 4. A suitable blower is used to conduct a stream of air through this air channel 21 to cool wall 4. The heated air of this stream can be sent advantageously as combustion air to the burner.

FIG. 10 shows a sixth exemplary embodiment of the furance boiler, which corresponds essentially to the exemplary embodiment of FIG. 9. So that the furnace boiler can be cleaned easily, a spray device 22 is provided in the upper part of the firebox. This spray device 22 consists of a heat-resistant pipe extending in the longitudinal direction of firebox 1 with outlets for a cleaning liquid, preferably water, distributed over its circumference and length. To çlean the entire furnace boiler, water or some other cleaning liquid is sprayed by spray device 22, as indicated by arrows in FIG. 10, either as needed or automatically at predetermined intervals. The water rinses off any combustion residues from wall 4 of firebox 1. Because the guide channels for the combustion gases pass vertically through heat exchanger 12 from top to bottom, the sprayed water also flows from top to bottom through heat exchanger 12 and rinses off any combustion residues which have been deposited on it. The entire amount of rinse water from wall 4 of firebox 1 and from heat exchanger 12 together with the rinsed-off combustion residues collects below in flue gas collection space 11, from which it is discharged through condensate drain 17.

If very cold water is supplied via return line R1 to heat exchanger 12 closer to burner flame 10, this could lead to the overcooling of burner flame 10. To prevent this, in the exemplary embodiment of FIG. 10, a line 24 is branched off from feed line V1, and through this branch a partial stream of the water heated in heat exchanger 12 is returned to feed line R1 and mixed with the cold feed water. A control valve 26 installed in line 24 controls the flow rate through line 24 in accordance with the temperature at the inlet point to heat exchanger 12, which temperature is determined by a sensor 28. In this way, a minimum temperature can be maintained in the water entering heat exchanger 12 via return line R1 to prevent the overcooling of burner flame 10 by upper heat exchanger 12 even when the burner output has been reduced and the return temperature is low.

SUMMARY

In a furnace boiler for gas or oil blowpipes, the firebox (1) is barrel-vaulted and open laterally over its entire length and width in the downward direction to a flue gas collection space (11), which contains heat exchangers (12). Wall (4) of firebox (1) is cooled only to the extent that the temperature on the inside wall (4) does not exceed about 600° C. The minimum cooling of firebox wall (4) makes it possible to reduce the burner output without overcooling the burner flame (10).

What is claimed is a:

1. Process for operating a furnace boiler with a firebox having a cooled wall and at least one blowpipe to direct flame into the firebox, and heat exchangers connected to the firebox through which the flue gases flow, consisting of the steps of extracting heat from the flue gases essentially only by the heat exchangers and cooling the wall of the firebox only to the extent that, at maximum burner output, the temperature on the inner side of the wall does not exceed approximately 600° C. and, when the burner output is reduced to about 1/10 of maximum output, the temperature does not fall below approximately 180° C.

2. Process according to claim 1, including directing the flame of the burner horizontally into the firebox and carrying the combustion gases from the firebox away downwards through the heat exchangers.

3. Process according to claim 1, including cooling the walls of the firebox by liquid-cooling, preferably water-cooling, and controlling the cooling in accordance with the temperature of the coolant.

4. Process according to claim 3, wherein the flow rate of the coolant is controlled in accordance with the temperature of the coolant.

5. Process according to claim 3, wherein the heat transfer from the walls of the firebox to the coolant is controlled in accordance with the temperature of the coolant.

6. Furnace boiler comprising at least one blowpipe, a firebox (1), enclosing the flame (10) of the blowpipe with a cooled wall (4), said firebox (1) being open over its entire length and width on one side essentially parallel to the axis of the flame (10), and extending into a flue gas collection space (11) containing heat exchangers (12), an outlet (13) connected to the flue gas collection space (11), temperature control means operable so that the wall (4) of the firebox (1) is cooled only to the extent that the temperature on the inside surface does not exceed approximately 600° C. at maximum burner output and does not fall below approximately 180° C. when burner output is reduced to about 1/10 of the maximum.

7. Furnace boiler according to claim 6, wherein the walls (4) of the firebox (1) are cooled by liquid-carrying coils of tubing (7, 7′, 7″) spaced a predetermined distance apart.

8. Furnace boiler according to claim 7, including an external wall (5) enclosing the wall (4) of the firebox (1) carrying said external wall (5), the coiled tubing (7, 7′, 7″) and touching the wall (4) only at certain points.

9. Furnace boiler according to claim 8, wherein said outer wall (5) consists of themally conductive sheet metal resting loosely under an applied pressure against wall (4), the sheet being preferably attached in a removable manner to the wall (4).

10. Furnace boiler according to claim 8, wherein said outer wall (5) rests with an adjustable pressure against the wall (4).

11. Furnace boiler according to claim 6, wherein said wall (4) of the firebox (1) consists of corrosion-resistant sheet steel.

12. Furnace boiler according to claim 6, wherein said wall (4) of the firebox consists of a ceramic material.

13. Furnace boiler according to claim 7, wherein said (4) of the firebox (1) consists of a thin-walled casting, preferably cast metal, onto which liquidcarrying coils of tubing (7) have been cast.

14. Furnace boiler according to claim 7, wherein said tubing coils (7, 7′, 7″) carry water which has been preheated in the heat exchanger (12).

15. Furnace boiler according to claim 7, including means for adjusting the flow rate through the coils of tubing (7, 7′, 7″) by means of a control valve (6, 18).

16. Furnace boiler according to claim 6, wherein said wall (4) of the firebox (1) is air-cooled.

17. Furnace boiler according to claim 16, wherein said wall (4) of the firebox (1) is enclosed by an air-tight shell (20), and including an air channel (21) between the wall (4) and the shell (20) surrounding the entire wall (4) and through which air passes.

18. Furnace boiler according to claim 6, wherein said firebox (1) has a curved vault and wherein the flame (10) of the burner burns essentially along the central axis of the firebox (10), said flue gas collection space (11) being located underneath the firebox (1), and the boundary surface between the firebox (1) and the flue gas collection space (11) occupying about $\frac{1}{4}$ to $\frac{1}{3}$ of the peripheral lateral surfaces of the firebox (1).

19. Furnace boiler according to claim 18, wherein said firebox (1) is about 1.5–1.0 times as long as it is wide.

20. Furnace boiler according to claim 18, wherein said firebox (1) is about 2.0-1.0 times as long as it is high.

21. Furnace boiler according to claim 6, wherein the volume of said firebox (1) is about 6–12 $dm^3$.

22. Furnace boiler according to claim 6, wherein said wall (4) jointly encloses the firebox (1), the heat exchangers (12), and the flue gas collection space (11) in a gas-tight manner.

23. Furnace boiler according to claim 6, wherein said wall (4) of the firebox (1) is removably connected to the heat exchangers (12) in a gas-tight and liquid-tight manner, where preferably the heat exchangers (12) are also removably connected in a gas-tight and liquid-tight manner to the flue gas collection space (11).

24. Furnace boiler according to claim 6, wherein said heat exchangers (12) have combustion gas channels which carry gas only vertically from top to bottom.

25. Furnace boiler according to claim 24, including a spray device (22) in the firebox (1) to introduce a cleaning liquid into the furnace boiler.

* * * * *